United States Patent [19]

Wass

[11] 4,103,826

[45] Aug. 1, 1978

[54] HEAT EXCHANGER FOR A FREESTANDING HEATING UNIT

[76] Inventor: Richard J. Wass, 376 Gorden Petty Ct., Brentwood, Tenn. 37027

[21] Appl. No.: 784,582

[22] Filed: Apr. 4, 1977

[51] Int. Cl.[2] ..... F24B 7/04

[52] U.S. Cl. ..... 237/55; 165/DIG. 2; 237/50; 24/273; 24/19

[58] Field of Search ..... 237/50, 51, 53, 55, 237/12.3 A; 165/DIG. 2, 122, 53; 24/273, 19, 274, 68 R, 68 T, 68 B; 122/20 B; 34/86

[56] References Cited

U.S. PATENT DOCUMENTS

| | | | |
|---|---|---|---|
| 369,169 | 8/1887 | Dewey | 237/53 |
| 1,226,710 | 5/1917 | Shakespeare et al. | 165/52 |
| 1,795,734 | 3/1931 | Otwell | 237/12.3 A |
| 1,968,214 | 7/1934 | Lonskey | 237/12.3 A |
| 2,452,170 | 10/1948 | Wenger | 237/12.3 A |
| 2,468,909 | 5/1949 | Yeager et al. | 237/55 |
| 2,529,915 | 11/1950 | Chausson | 237/12.3 A |
| 3,261,062 | 7/1966 | Scarborough, Jr. | 24/19 |
| 3,748,697 | 7/1973 | Marchese et al. | 24/19 |
| 3,911,894 | 10/1975 | Richard, Jr. et al. | 237/55 |
| 4,018,208 | 4/1977 | Hamilton | 237/51 |

FOREIGN PATENT DOCUMENTS

| | | | |
|---|---|---|---|
| 2,419,398 | 11/1975 | Fed. Rep. of Germany | 237/55 |
| 2,521,444 | 11/1975 | Fed. Rep. of Germany | 237/55 |
| 206,137 | 10/1939 | Switzerland | 237/50 |

OTHER PUBLICATIONS

Popular Mechanics, Oct. 1974, p. 153.

*Primary Examiner*—John J. Camby
*Assistant Examiner*—Henry C. Yuen
*Attorney, Agent, or Firm*—Morse, Altman, Oates & Bello

[57] ABSTRACT

A heat exchanger with a tubular body having helical ribs about its periphery constituting expanded interior and exterior conductive heating surfaces. A clamp is captively held to the tubular body for mounting the heat exchanger to the exhaust duct of a freestanding heating unit. Hot gases passing through the exhaust duct conductively heat is the expanded surface of the tubular body and air therein. A thermostatically controlled blower directs the heated air within the tubular body towards a heated surface of the freestanding heating unit for convectively heating the area about the unit.

5 Claims, 3 Drawing Figures

HEAT EXCHANGER FOR A FREESTANDING HEATING UNIT

BACKGROUND OF THE INVENTION

1. Field of Invention

The present invention relates to heating device, and more particularly, is directed towards heat exchangers for freestanding heating units.

2. Description of the Prior Art

Freestanding heating units are inefficient heat sources inasmuch as a great percentage of the heat passes through the exhaust duct and out of the chimney. Various devices, which have been designed to utilize this wasted heat, have been introduced with varying degree of success.

SUMMARY OF THE INVENTION

It is an object of the present invention to provide a heat exchanger which increases the efficiency of freestanding heating units.

Another object of the invention is to provide a heat exchanger which utilizes the heated surface and heretofore wasted heat of freestanding heating units for increased efficiency.

The heat exchanger of the present invention includes a tubular body with inlet and oulet ports at opposite ends and having a ribbed shell defining expanded interior and exterior conductive heating surfaces. A thermostatically controlled blower is mounted within the tubular body for drawing air into the inlet port and exhausting air through the outlet port. A clamp captively held to the tubular body is provided for mounting the heat exchanger to an exhaust duct of a freestanding heating unit, longitudinal axis of the tubular body and exhaust duct being in space parallel relationship for maximum heat transfer. The clamp is disposed about an axis which is parallel to the longitudinal axis of the tubular body, the outlet port facing an exposed surface of the freestanding heating unit that is heated when the unit is operating. During the operating cycle of the freestanding heating device, hot air exiting through the exhaust duct heats the expanded surface of the tubular body and the air contained therein. When the temperature reaches a predetermined level, the blower is energized and the heated air within the tubular body is directed towards the exposed heated surface of the freestanding heating unit for convectively heating the area about the freestanding unit.

Other objects of the present invention will in part be obvious and will in part appear hereinafter.

The invention accordingly comprises the apparatuses and systems, together with their parts, elements and inter-relationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
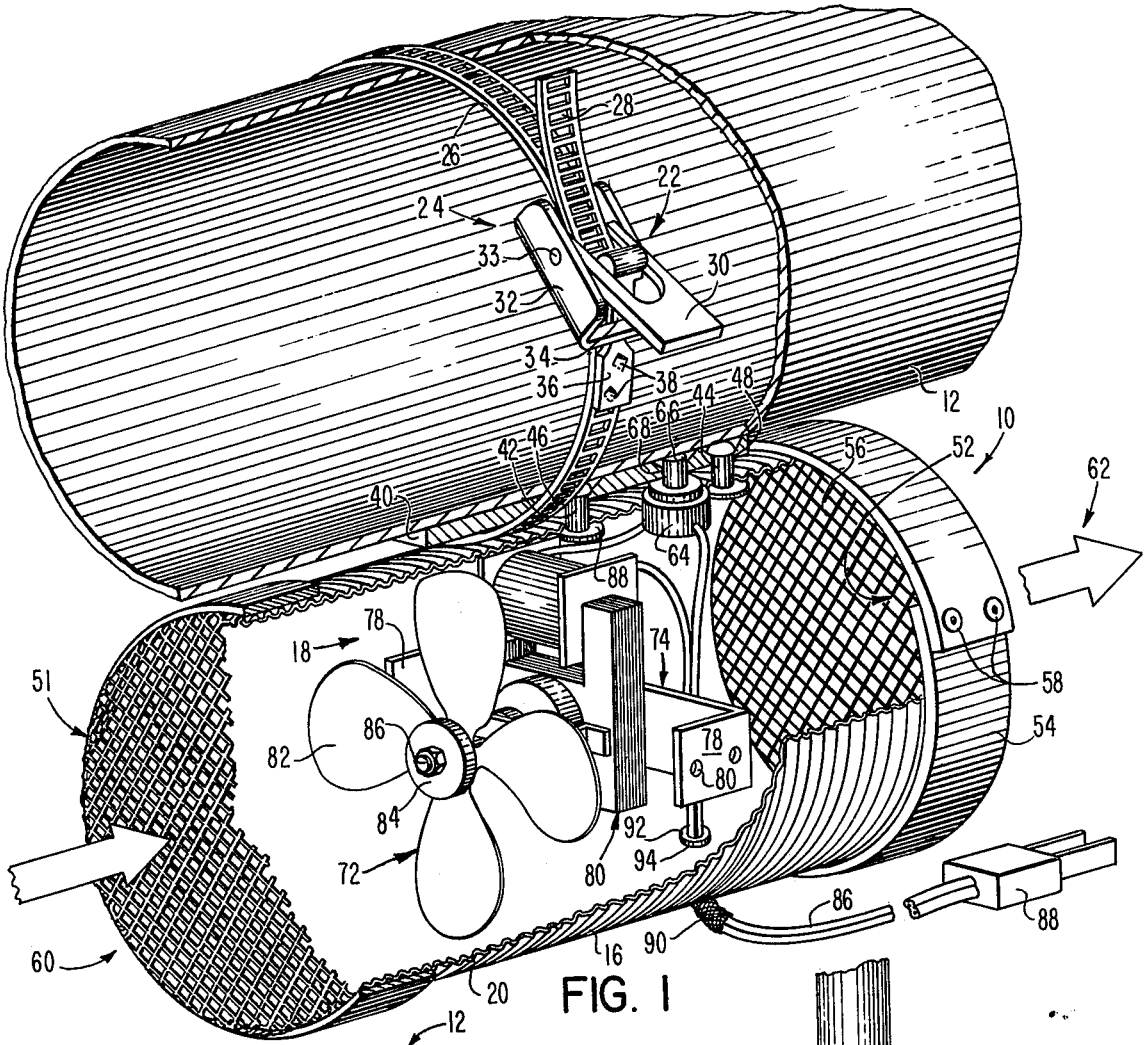
FIG. 1 is a cutaway perspective view of the heat exchanger embodying the invention.

Generally, the invention features a heating system in which a heat exchanger 10 is mounted to an exhaust duct 12 of a freestanding heating unit 14. Heat exchanger 10 includes a tubular body 16 that is conductively heated when hot gases from heating unit 14 pass through exhaust duct 12. A thermostatically controlled blower 18 directs the heated air within tubular body 16 towards a surface area this is heated when heating unit 14 is operating. The stream of air is convectively heated as it passes the heated surface, whereby the area about freestanding heating unit 14 is efficiently heated.

As shown in FIG. 1, tubular body 16 includes helical ribs 20 which constitute expanded interior and exterior conductively heating surfaces, the peak to valley dimension of the ribs being in the range of 0.015 inch to 0.5 inch and preferably 0.125 inch. Tubular body 16 is composed of a heat resistant metal, such as stainless steel, steel or aluminum, having a thickness in the range of 0.004 inch to 0.25 inch and preferably 0.12 inch. The diameter of tubular body 16 is in the range of 4 inches to 8 inches and preferably 5 inches. Typically the length of tubular body 16 is in the range of 4 inches to 12 inches and preferably 8 inches.

Heat exchanger 10 is mounted to exhaust duct 12 by a clamp 22 which includes a ratchet mechanism 24 and an endless band 26 formed with a series of evenly spaced openings 28. Ratchet mechanism 24 includes a lever 30 which is pivotally mounted to a frame 32 by a pin 33. One end of endless band 26 is captively held to frame 32 and the other end of band 26 is threaded through a guide 34 in frame 32. A pawl 36 having a pair of barbs 38 at one end is pivotally mounted to lever 30, the barbed end of the pawl slidably received in guide 34. When lever 30 is pivoted towards guide 34, pawl 36 moves along opening 28. When lever 30 is pivoted away from guide 34, barbs 38 engage openings 28 and tighten band 26 about exhaust duct 12, the barbs are positioned to engage adjacent one of the openings. In order to further tighten band 26, lever 30 is pivoted towards guide 34 while the band is held so as not to slide backwards and loosen. Barbs 38, extend outwardly from the underside of pawl 36 at an acute angel so as not to catch openings 28 when lever 30 is moved towards guide 34. After lever 30 reaches its rearward most position adjacent guide 34, as shown in FIG. 1, barbs 38 engage openings 28. Then, lever 30 is pivoted towards its forward most positioned and pawl 36 pulls band 26 tighter about exhaust duct 12.

Band 26 is constrained by a substantially rectangular bar 40 that is mounted to heat exchanger 10. Bar 40 is fastened to tubular body 16 by a pair of rivets 42 and 44 that are received in through holes 46 and 48, respectively. The longitudinal axis of bar 40 is in spaced parallel relationship with the longitudinal axis of tubular body 16. Holes 46 and 48 are countersunk at the surface of bar 40 adjacent exhaust duct 12 so that rivets 42 and 44 do not extend beyond the upper surface of the bar. Band 26 is threaded about the margin of bar 40 adjacent rivet 42 and is disposed about an axis that is in spaced parallel relationship with the longitudinal axis of tubular body 16.

The opened ends of tubular body 16 are provided with a pair of caps 50 and 51, each of which is composed of a metal such as stainless steel, steel or aluminum. Each one of caps 50 and 51 includes a face plate 52 and an annular flange 54. Face plate 52 includes a plurality of interwoven strips 56 in a mesh configuration that define an air deflector. The margins of face plate 52 are wrapped about the margins of tubular body 16 and flange 54 is wound about the wrapped margins of the face plate. A pair of rivets 58 secure flange 54 to tubular body 16. Air is drawn inwardly through cap 51, which constitutes an inlet port 60, and exits through cap 50, which constitutes an outlet port 62.

As previously indicated, air within tubular body 16 is conductively heated when hot gases from freestanding heating unit 14 passes through exhaust duct 12. The orientation of tubular body 16 with respect to exhaust duct 12 provides maximum adjacent surface areas for increased heat conduction from the exhaust duct to heat exchanger 10. In addition, thermal conduction is enhanced by the expanded exterior heating surface provided by ribs 20. Heating of the air within tubular body 16 is enhanced by the expanded interior heating surface provided by ribs 20.

A temperature sensor 64, preferably a snap action bimetallic thermostat, is mounted to tubular body 16 adjacent exhaust duct 12 and senses the temperature changes about the exhaust duct and energizes blower 18. Thermostat 64 is provided with a stud 66 that is received within a hole 68 provided in bar 40, a free end of the stud being received in a countersunk end of hole 68. Bar 40 constitutes a heat sensing or heat sink for thermostat 64 so that the thermostat is subjected to gradual termperature changes, whereby the system does not cycle rapidily. Typically, thermostat 106 closes at a temperature rise in the range of 100° F to 140° F, preferably 110° F, and opens at a temperature drop in the range of 80° F to 120° F, preferably 95° F. That is, in the preferred embodiment, when the temperature about thermostat 64 rises to approximately 110° F, the thermostat closes and blower 18 is engerized and when the temperature about thermostat 64 drops to approximately 95° F, the thermostat opens and blower 18 is deenergized.

Blower 18 includes a motor 70, for example a brush or brushless shaded pole AC motor, and a blade assembly 72. Motor 70 is mounted to a bracket 74 which is fastened to the interior surface of tubular body 16. Bracket 74 includes a body 76 and a pair of legs 78 that are provided with holes 80 which are configured to receive rivets (not shown) for fastening the bracket within tubular body 16. Motor 70 is mounted to body 76 of bracket 74. Blade assembly 72 includes a plurality of blades 82, preferably four blades, that are disposed about a hub 84 that is carried on a shaft 86 of motor 70. Blades 82 are pitched to draw air inwardly through port 60 and the unencumbered portion of tubular body 16 for maximum air flow. That is, the pitch of blades 82 is such that the inwardly drawn air is pushed outwardly towards the tips of the blades and interior surface of the tubular body 16 as its directed towards outlet port 62. It has been found that a reduced flow of air is provided if the air is drawn inwardly across motor 70. The volume air flow is incresed if the flow is unemcumbered as it is drawn inwardly towards blades 82 and the volume of air flow is decreased if the flow is encumbered as it is drawn inwardly towards the blades. That is, a vortex action is created without any substanital loss in air flow if the air is drawn inwardly towards blades 82 and then flows about motor 70.

As previously indicated, thermostat 64 is operative between closed and opened states for energizing and deenergizing motor 70. Power is supplied to motor 70 via a two conductor cord 86 having a plug 88. One conductor of cord 86 is connected to one side of motor 70 and the other conductor is connected to one side of thermostat 64. A line 88 is connected between the other side of motor 70 and the other side of thermostat 64. Preferably, a sleeve 90 composed of a high temperature resistance material such as a fiberglass is provided about cord 86. A strain relief device 92 or a grommet, composed of rubber or plastic, is inserted into an opening 94 in tubular body 16 through which cord 86 passes for abrassion protection.

Figure 2:
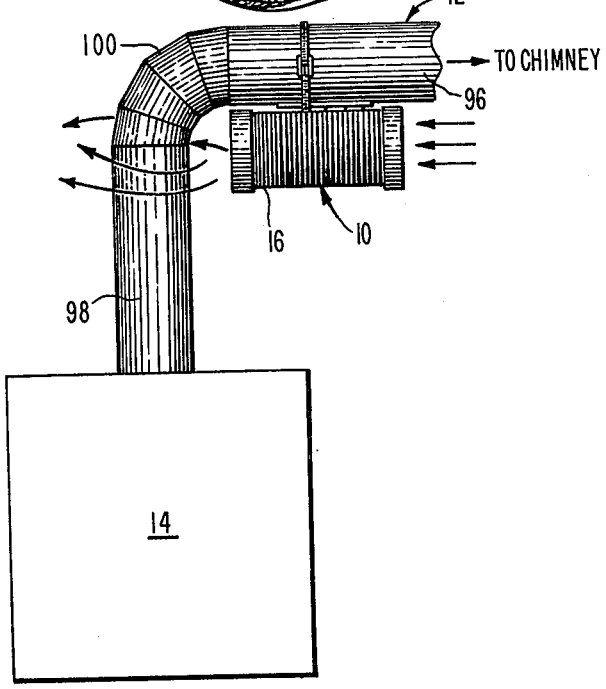
FIG. 2 is a perspective view of the heat exchanger of FIG. 1 horizontally mounted.

In operation, heat exchanger 10 is clamped to exhaust duct 12 of freestanding heating unit 14, for example a furnace, as shown in FIG. 2. Tubular body 16 is parallel to a substantially horizontal section 96 of exhaust duct 12 and outlet port 62 faces a substantially vertical section 98 of exhaust duct 12, the horizontal and vertical sections being connected by an elbow 100. When furnace 14 is operating, hot gases flow through exhaust duct 12 and out the chimney. The hot gases heat exhaust duct 12 which, in turn, conductively heats tubular body 16 and radiantly heats the air therein. When the temperature of exhaust duct reaches a predetermined level, for example 110° F, thermostat 64 closed and motor 70 is energized. In consequence, air is directed towards heated vertical section 98 for warming the area about furnace 14. As air is drawn inwardly through inlet port 60, it is convectively heated by the expanded interior heating surface of tubular body 16. In addition, the heated air discharged through outlet port 62 is convectively heated as it passes about heated vertical section 98. When furnace 14 is shut off and the temperature about thermostat 64 drops below a predetermined level, for example 95° F, the thermostat opens and motor 70 is deenergized.

Figure 3:
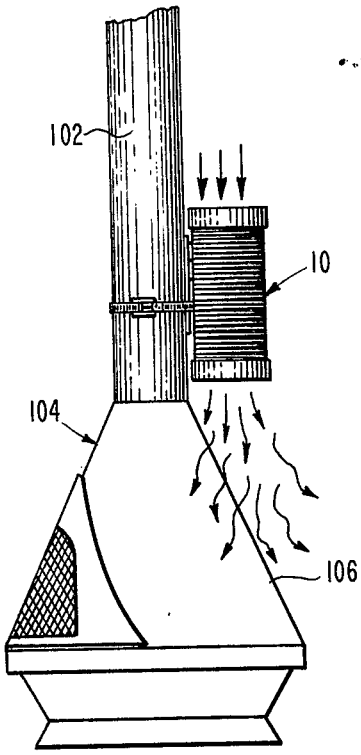
FIG. 3 is a perspective view of the heat exchanger of FIG. 1 vertically mounted.

In the alternative embodiment shown in FIG. 3, heat exchanger 10 is mounted to a substantially vertical exhaust duct 102 of a freestanding stove 104. Heat exchanger 10 is mounted adjacent to body 106 of stove 104. When stove 104 is operating, the surface area of body 106 is heated. The operation of heat exchanger 10 mounted in the configuration of FIG. 3 is similar to the operation described in connection with FIG. 2. The convectively heated air within tubular body 16 is directed towards the heated surface of body 106 when thermostat 64 is closed.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A heat exchanger for a freestanding heating unit having an exhaust duct, said heat exchanger comprising:

(a) a tubular body having inlet and outlet ports at opposite ends;

(b) a bracket mounted to the outer surface of said tubular body;

(c) a clamp constrained by said bracket, said clamp configured to captively hold said tubular body to said exhaust duct of said freestanding heating unit, said clamp disposed about an axis that is parallel to a longitudinal axis of said tubular body, a longitudinal axis of said tubular body in spaced parallel relationship to a longitudinal axis of said exhaust duct when said heat exchanger is mounted to said exhaust duct;

(d) a temperature sensor mounted to said bracket, said temperature sensor having opened and closed states; and (e) a blower including a motor and a blade assembly, said motor mounted within said tubular body and electrically connected to said temperature sensor, said motor having energized and deenergized states, said blade assembly is connected to said motor and is operative to create an air flow inwardly through said inlet port, about said motor and outwardly through said outlet port;

(f) a power line connected to said temperature sensor and said blower, (g) said motor in its energized state when said temperature sensor is in its closed state, said motor in its deenergized state when said temperature sensor is in its opened state, (h) said tubular body includes a plurality of ribs about its periphery, said ribs forming expanded interior and exterior conductive heating surfaces;

(i) a cap mounted to each end of said tubular body, each said cap having a face plate with a plurality of interwoven strips defining an air deflector and a band, the margins of each said face plate wrapped about the margin of said tubular body, said band superposed on the wrapped margins of said face plate, said band mounted to said tubular body and captively holding said face plate to said tubular body.

2. The heat exchanger as claimed in claim 1 wherein said blade assembly includes four blades, each said blade connected to a hub, said hub mounted to a shaft of said motor, said blades disposed adjacent said inlet port, said motor disposed between said blades and said outlet port, each said blade having a predetermined pitch for creating a vortical air flow about said motor.

3. A heating system comprising:

(a) a freestanding heating unit having an exhaust duct that is heated when said freestanding heating unit is operating; and (b) a heat exchanger including a tubular body having inlet and outlet ports at opposite ends, means for mounting said tubular body to said exhaust duct of said freestanding heating unit with a longitudinal axis of said tubular body in spaced parallel relationship with a longitudinal axis of said exhaust duct, said outlet port facing a surface of said freestanding heating unit that is heated when said freestanding heating unit is operating, a temperature sensor mounted to said tubular body adjacent said exhaust duct, said temperature sensor having opened and closed states, said temperature sensor responsive to temperature changes of said exhaust duct, said temperature sensor sctuated to its closed state when the temperature of said exhaust duct reaches a predetermined level, a blower mounted within said tubular body, said blower having energized and deenergized states, said blower electrically connected to said temperature sensor, said blower in its energized state when temperature sensor is in its closed state, said blower in its deenergized state when said temperature sensor is in its opened state; and a power cord connected to said temperature sensor and said blower;

(c) said exhaust duct conductively heating said tubular body, air within said tubular body radiantly heated by said heated tubular body, said blower directing the heated air within said tubular body towards a heated surface of said freestanding heating unit for convectively heating the area about said freestanding heating unit, (d) said tubular body includes a plurality of ribs helically disposed about its periphery, said ribs forming peaks and valleys on said periphery, said peaks and valleys constituting interior and exterior expanded conductive heating surfaces, (e) said mounting means includes a bracket and a clamp, said bracket mounted to said tubular body on an external surface thereof, said clamp captively held to said bracket, said clamp disposed about an axis that is in spaced parallel relationship with said longitudinal axis of said tubular body, said clamp configured to captively hold said heat exchanger to said freestanding heating unit;

(f) said clamp includes a ratchet member and an endless band, one end of said band captively held to said ratchet member, the other end of said band threaded through said ratchet member, said band constrained for movement relative to said ratchet member for tightening said band about said exhaust duct.

4. The heating system as claimed in claim 3 wherein the peak to valley dimension is in the range of .015 inch to 0.5 inch.

5. The heating system as claimed in claim 3 wherein said tubular member is composed of stainless steel.

* * * * *